US012466616B2

(12) United States Patent
Beaufore et al.

(10) Patent No.: US 12,466,616 B2
(45) Date of Patent: Nov. 11, 2025

(54) CONTAINER WITH A LID-COLLAR ASSEMBLY

(71) Applicant: ABBOTT LABORATORIES, Abbott Park, IL (US)

(72) Inventors: Spencer Beaufore, Dublin, OH (US); Kyle Demmink, Columbus, OH (US)

(73) Assignee: ABBOTT LABORATORIES, Abbott Park (IL)

( * ) Notice: Subject to any disclaimer, the term of this patent is extended or adjusted under 35 U.S.C. 154(b) by 77 days.

(21) Appl. No.: 18/253,885

(22) PCT Filed: Nov. 22, 2021

(86) PCT No.: PCT/US2021/060310
§ 371 (c)(1),
(2) Date: May 22, 2023

(87) PCT Pub. No.: WO2022/109383
PCT Pub. Date: May 27, 2022

(65) Prior Publication Data

US 2024/0017891 A1 Jan. 18, 2024

Related U.S. Application Data

(60) Provisional application No. 63/117,109, filed on Nov. 23, 2020.

(51) Int. Cl.
*B65D 43/16* (2006.01)

(52) U.S. Cl.
CPC .. *B65D 43/169* (2013.01); *B65D 2543/00527* (2013.01); *B65D 2543/00537* (2013.01);
(Continued)

(58) Field of Classification Search
CPC ..... B65D 51/247; B65D 43/164; B65D 2543/00527
See application file for complete search history.

(56) References Cited

U.S. PATENT DOCUMENTS 6,123,212 A 9/2000 Russell et al.
9,505,534 B2 11/2016 Mercado et al.
(Continued)

FOREIGN PATENT DOCUMENTS

DE 20209535 U1 12/2003
DE 10230695 A1 1/2004
(Continued)

OTHER PUBLICATIONS

International Search Report and Written Opinion from PCT/US2021/060310 dated Mar. 11, 2022 (14 pages).

*Primary Examiner* — Jeffrey R Allen
(74) *Attorney, Agent, or Firm* — McAndrews, Held & Malloy, Ltd.

(57) ABSTRACT

A container (100) having a main body (104) including one or more sidewalls (106) having an interior surface (120) and an exterior surface (122) and defining an interior compartment (108), the one or more sidewalls having an upper portion (114) defining a circular opening (110) to the interior compartment and an annular flange (128) extending from the exterior surface and a lid-collar assembly (112, 116) comprising a lid (116) attached to a collar (112) affixed to the main body, the collar having an inner side surface (162) positioned radially outward of the annular flange and a plurality of longitudinally extending ribs (210) spaced apart on the inner side surface, wherein the plurality of ribs engage the annular flange to resist rotation of the lid-collar assembly relative to the main body.

19 Claims, 4 Drawing Sheets

(52) U.S. Cl.
CPC ..... *B65D 2543/00574* (2013.01); *B65D 2543/00629* (2013.01)

(56) References Cited

U.S. PATENT DOCUMENTS

| | | | | |
|---|---|---|---|---|
| 10,549,883 | B2 | 2/2020 | Gonzalez Sanchez | |
| 2008/0156808 | A1 | 7/2008 | Perry et al. | |
| 2010/0108670 | A1* | 5/2010 | Perry | B65D 51/247 220/849 |
| 2015/0129597 | A1* | 5/2015 | McBroom | B65D 43/22 220/324 |
| 2018/0170613 | A1 | 6/2018 | Hu et al. | |
| 2019/0177045 | A1* | 6/2019 | Schoenmakers | B65D 43/0212 |
| 2019/0300236 | A1* | 10/2019 | Herlin | B65D 51/20 |

FOREIGN PATENT DOCUMENTS

| | | | |
|---|---|---|---|
| FR | 3026093 | A1 | 3/2016 |
| WO | 2019/162685 | A1 | 8/2019 |

* cited by examiner

CONTAINER WITH A LID-COLLAR ASSEMBLY

CROSS REFERENCE TO RELATED APPLICATIONS

This application is the U.S. national stage entry of PCT/US2021/060310, with an international filing date of Nov. 22, 2021 and claims priority to and the benefit of U.S. Patent Application No. 63/117,109, filed on Nov. 23, 2021, the entire contents of which are incorporated herein by reference in their entirety.

FIELD OF THE INVENTION

This invention related to the field of packaging, and more particularly, packaging having lids attached to a container body.

BACKGROUND

Many types of products, such as granular or powdered products (e.g., infant formula, flour, coffee, sugar, etc.), are packaged in containers having lids. The containers may come in a variety of configuration. In some instances, the lids of the containers can rotate out of position (orientation) when assembled onto a container having a round opening. Lid orientation is often desired to align a lid feature and/or lid messaging with a certain position on the container.

SUMMARY

According to one aspect of the present disclosure, a container is provided having a main body including one or more sidewalls having an interior surface and an exterior surface and defining an interior compartment, the one or more sidewalls having an upper portion defining a circular opening to the interior compartment and an annular flange extending from the exterior surface and a lid-collar assembly comprising a lid attached to a collar affixed to the main body, the collar having an inner side surface positioned radially outward of the annular flange and a plurality of longitudinally extending ribs spaced apart on the inner side surface, wherein the plurality of ribs engage the annular flange to resist rotation of the lid-collar assembly relative to the main body.

In another aspect of the present disclosure, a method of securing a collar-lid assembly onto a container body is provided where the collar-lid assembly includes an inner side surface and the container body includes one or more sidewalls having an interior surface and an exterior surface and defining an interior compartment, the one or more sidewalls having an upper portion defining a circular opening to the interior compartment and an annular flange extending from the exterior surface. The method includes pressing the collar-lid assembly onto the container body such that the inner side surface is radially outward of the exterior surface, positioning one or more retaining elements located on the inner side surface beneath the annular flange to resist axial separation of the collar-lid assembly from the container body, and creating a friction fit between one or more anti-rotation elements on the inner side surface and the annular flange to resist rotation of the collar-lid assembly relative to the container body.

Further features and advantages of the invention will become apparent from the following detailed description made with reference to the accompanying drawings.

BRIEF DESCRIPTION OF THE DRAWINGS

Features and advantages of the general inventive concepts will become apparent from the following detailed description made with reference to the accompanying drawings.

DETAILED DESCRIPTION

This Detailed Description merely describes exemplary containers and methods in accordance with the general inventive concepts and is not intended to limit the scope of the invention or the claims in any way. Indeed, the invention as described by the claims is broader than and unlimited by the exemplary containers and methods set forth herein, and the terms used in the claims have their full ordinary meaning.

Figure 1:
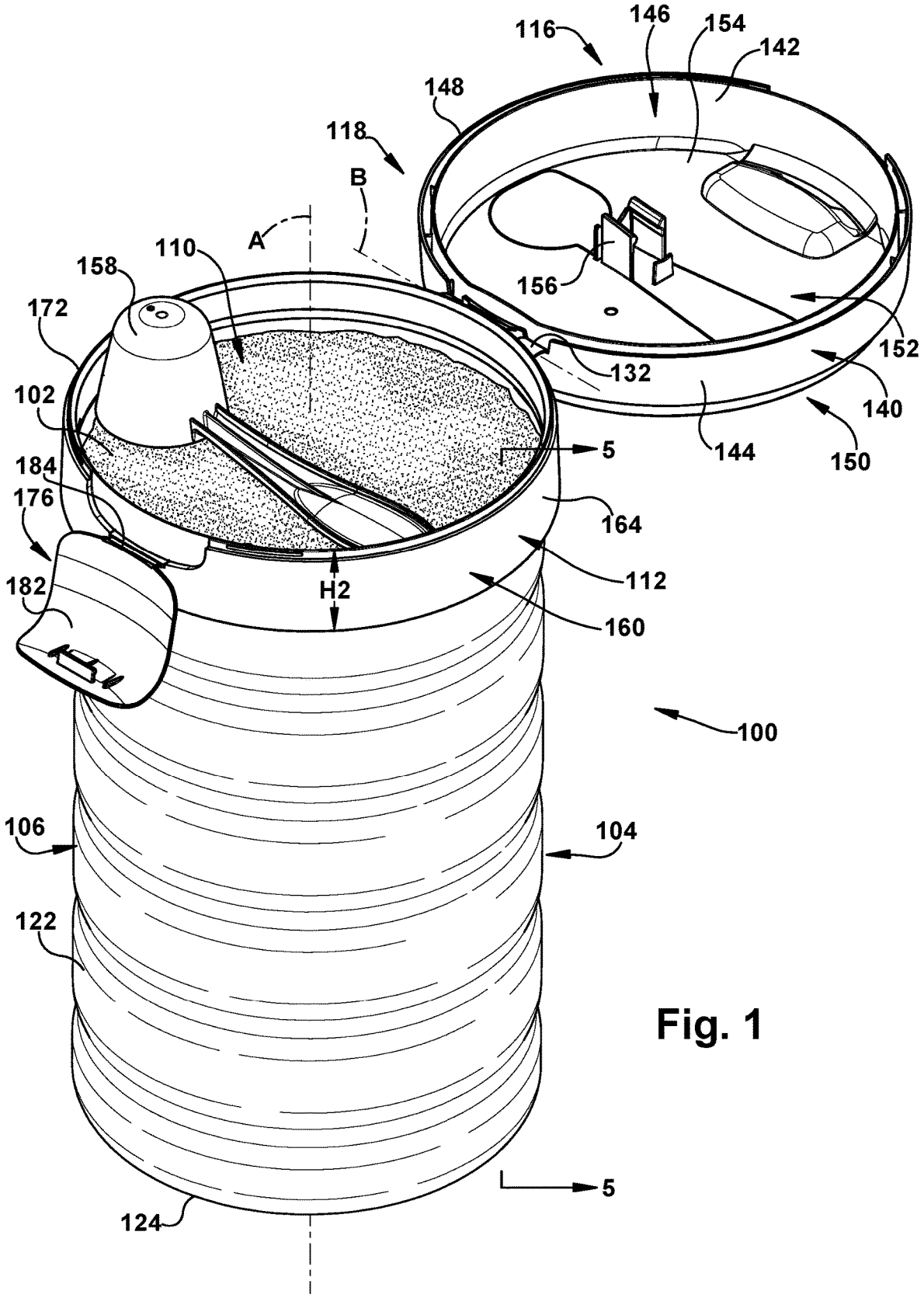
FIG. 1 is a perspective view of an exemplary configuration of a container including a collar-lid assembly.

FIG. 1 is a perspective view of an exemplary container 100 for holding contents 102, such as for example, a powdered or granulated material. The container 100 may include a body 104 having one or more sidewalls 106 defining an interior compartment 108 (FIG. 5) that is configured to hold the contents 102 and a circular, or near circular, opening 110 to the interior compartment 108. A collar 112 is attached to an open upper portion 114 (FIG. 5) of the body 104, and a lid 116 is attachable to the collar 112. As will be described in more detail below, the container 100 may include one or more features that prevents, or resists, rotation of the collar 112 relative to the body 104 when the collar 112 is attached to the upper portion 114 of the body 104.

The body 104 may be configured in a variety of ways. Although the body 104 of the exemplary container 100 is described and illustrated to be substantially cylindrical, the present invention is susceptible for use with all shapes and sizes of containers including cuboid, obloid, rectilinear, and other shapes, which may have a circular, or near circular opening. Furthermore, each of the optional and preferred examples of the invention contemplate interchangeability with all of the various features, components, modifications, and variations illustrated throughout the written description and pictorial illustrations.

Figure 5:
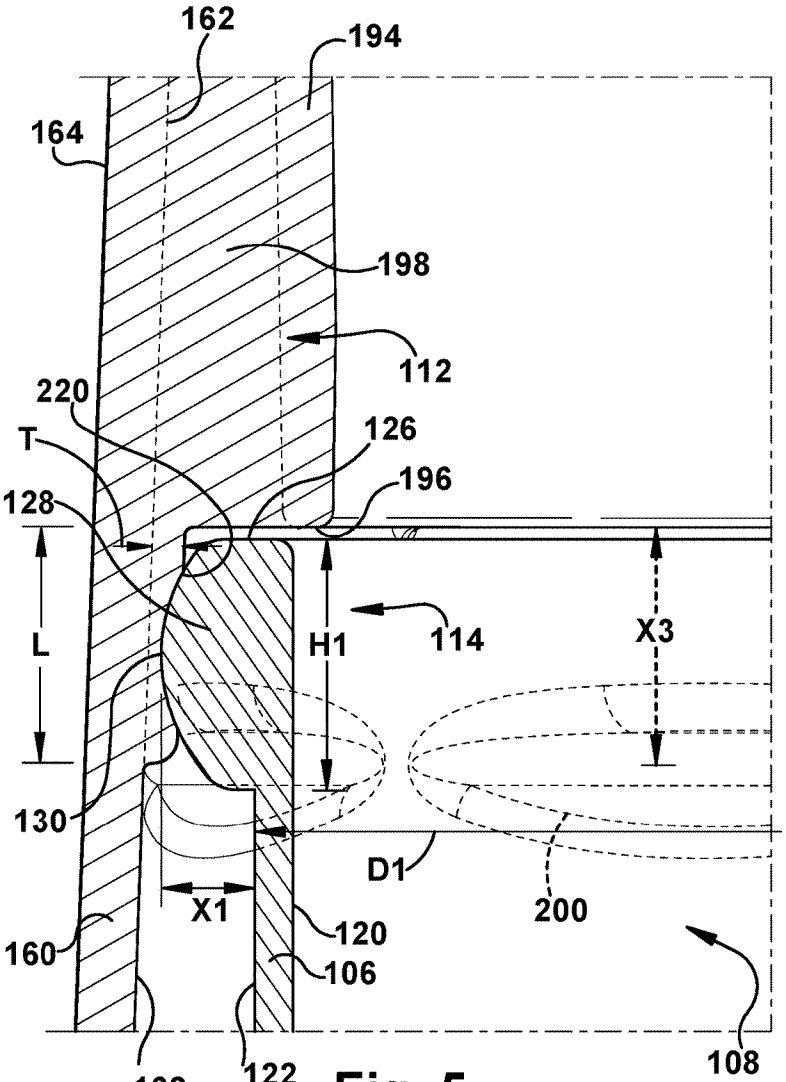
FIG. 5 is a partial section view of the container in the area the collar is attached to a body of the container.

In the illustrated container, the body 104 is substantially cylindrical about a longitudinal axis A with a cylindrical side wall 106 having an inner surface 120 (FIG. 5) and an outer surface 122 opposite and generally parallel to the inner surface 120. The body 104 includes a closed bottom end 124 opposite the upper portion 114. The upper portion 114 includes an upper circumferential edge 126 (FIG. 5) and an annular radially extending portion 128 (FIG. 5), such as, for example, a flange or can seam, extending radially from the outer surface 122. In the illustrated container, the annular radially extending portion is an annular flange 128 that extends around the entire circumference of the upper portion 114 and is coextensive with the upper circumferential edge 126. In other configurations of the container, however, the annular flange 128 may be spaced apart from the upper circumferential edge 126. The outer surface 122 of the upper portion 114 of the body 104 adjacent and below the annular flange 128 has diameter D1 (FIG. 5).

The annular flange 128 may be configured in a variety of ways, including different shapes and sizes of the flange 128. In the illustrated container, the annular flange 128 has a height H1, extends a maximum distance X1 from the outer surface 122, and has a curved exterior surface 130. The body 104 may be constructed from any suitable material. In one embodiment, the container 100 is constructed from a polymeric material, such as, for example, polypropylene high-density polyethylene (HDPE), low-density polyethylene (LDPE), polyethylene terephthalate (PET), and/or polycarbonate.

The collar 112 and the lid 116 may be configured in a variety of ways. The collar 112 and the lid 116 may be formed as an integral collar-lid assembly 118 or the collar 112 and the lid 116 may be separate components that may attach together in any suitable manner. The lid 116 is moveable relative to the collar 112 between an closed position in which the lid 116 covers the opening 110 to the interior compartment 108 or an open position in which the opening 110 is not covered by the lid 116 and the contents of the container 100 are accessible via the opening 110.

The lid 116 may be attachable to the collar 112 in a variety of ways. Any configuration that allows the lid 116 to move between the open and closed positions may be used. Non-limiting examples may include (i) the lid 116 includes threads that allow the lid 116 to screw onto corresponding threads on the collar 112, (ii) the lid 116, and/or collar 112, have a detent mechanism that allows the lid 116 and collar to snap together, or (iii) the lid 116 is joined to the collar 112 with a hinge that allows the lid 116 to pivot relative to the collar 112.

Referring to FIG. 1, the collar 112 is connected to the lid 116 by a hinge 132 that allows the lid 116 to pivot relative to the collar 112 about axis B. The hinge 132 may be a living hinge such that the lid 116 and the collar 112 are integrally formed together by the hinge 132. In other configurations of the container, however, the hinge 132 may not be a living hinge. For example, the hinge 132 may be a separate component that attaches the collar 112 to the lid 116 or may be formed by structure on both the collar 112 and lid 116 that allow the lid 116 to pivot relative to the collar 112.

In the illustrated container, the lid 116 is generally cylindrical with a cylindrical side wall 140 having an inner surface 142 and an outer surface 144 opposite of and generally parallel to the inner surface 142. The lid 116 has an open lower end 146 having a lower circumferential edge 148 and a closed upper end 150 having a top wall 152 with an inner surface 154. In the illustrated container, the lid 116 includes a scoop holder 156 for holding and storing a scoop 158 onto the inner surface 154 of the top wall 152. The container 100 may also include a removable, substantially moisture-impervious, oxygen-impervious seal (not shown) between the lid 116 and the interior compartment 108.

In the illustrated container, the collar 112 is generally ring-shaped with a cylindrical side wall 160 having a height H2, an inner surface 162, and an outer surface 164 opposed to and generally parallel to the inner surface 162. The inner surface 162 has a diameter D2 configured to fit over the upper portion 114 of the body 104. The collar 112 has an open lower end 166 having a lower circumferential edge 168 and an open upper end 170 having an upper circumferential edge 172.

Figure 2:
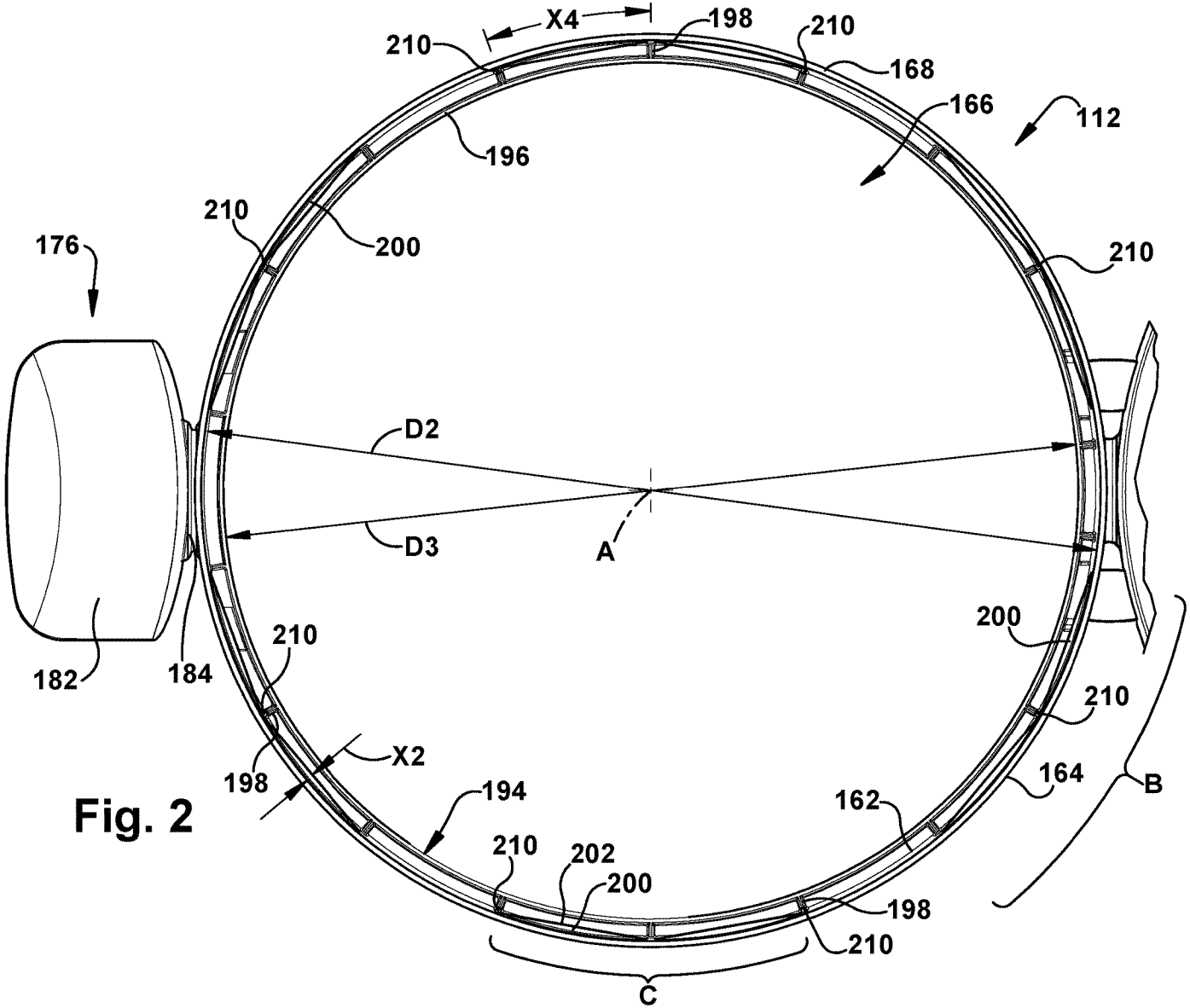
FIG. 2 is a bottom view of the collar of the container of FIG. 1.

Referring to FIGS. 1-2, the lid 116 and the collar 112 may have a cooperating container-locking feature 176 to securely retain the lid 116 in the closed position. The container-locking feature 176 may be configured in a variety of ways. Any suitable configuration that can hold the lid 116 in the closed position when desired may be used. In the illustrated container, the container-locking feature includes a latch 182 on the collar 112 and a keeper (not shown) on the lid 116. The latch 182 is positioned on or extending from the outer surface 164 of the collar 112 via a hinge 184 that allows the latch 182 to pivot relative to the collar 112 between a latched position and an unlatched position. In the latched position, the latch 182 grips the keeper (not shown) to hold the lid 116 in the closed position.

Figure 3:
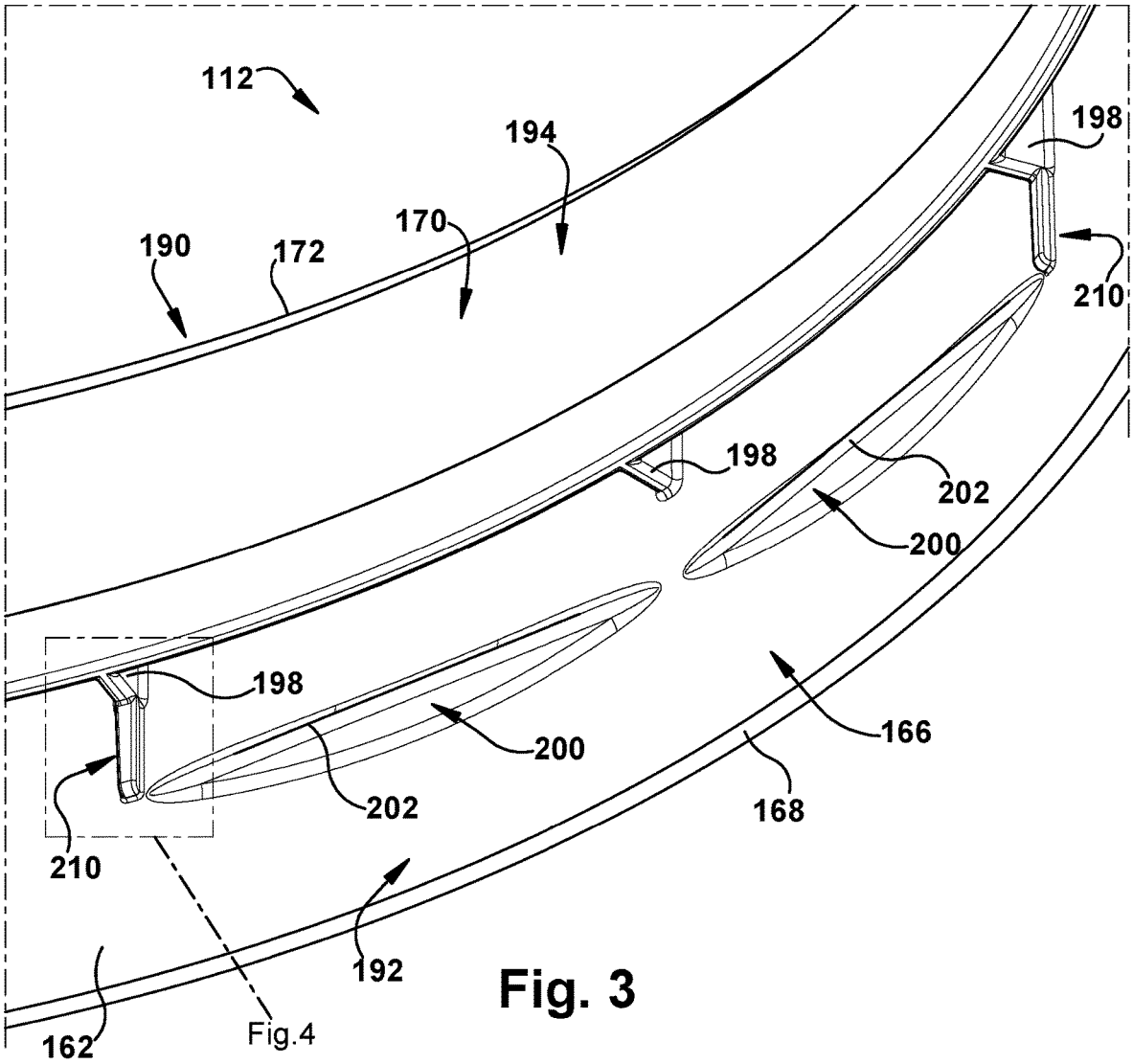
FIG. 3 is a partial perspective view of an inner surface of the collar.

Referring to FIG. 3, in the illustrated container, the inner surface 162 of the collar 112 includes an upper portion 190 and a lower portion 192. The upper portion 190 is proximal the open upper end 170 and the lower portion 192 is proximal the open lower end 166. The upper portion 190 of the inner surface 162 includes an inner wall 194 spaced radially inward from the inner surface 162. The inner wall 194 extends from the open upper end 170 toward the open lower end 166 a distance that is less than height H2 (FIG. 1) of the collar 112. In other words, the inner wall 194 does not extend all the way to the lower circumferential edge 168. For example, the inner wall 194 may extend from the open upper end 170 toward the open lower end 166 a distance that is in the range of 30% to 70% the height H2 of the collar 112, or 40% to 60% the height H2 of the collar 112. In other configurations of the container, however, the inner wall 194 may not extend to the open upper end 170. The inner wall 194 has an inner diameter D3 that is less than the diameter D2 of the inner surface (FIG. 2).

The inner wall 194 includes a lower circumferential edge 196 and is connected to the inner surface 162 of the upper portion 190 of the collar 112 by a plurality of radially-extending bridges 198. The bridges 198 may be configured in a variety of ways, including the number, the size, and the location of the bridges 198. In the illustrated container, the inner wall 194 is connected to the inner surface by eighteen (18) bridges 198 spaced around the outer circumference of the inner wall 194. In some configurations of the container, the bridges 198 are equally spaced around the outer circumference of the inner wall 194. In other configurations, however, the bridges 198 may not be equally spaced. Each of the plurality of bridges has a thickness similar to the thickness of the inner wall 194, such as for example 75% to 125% the thickness of the inner wall 194. In other configurations of the container, however, the number of bridges 198 may be less than or more than eighteen, the bridges may not be equally spaced, and/or the thickness of the bridges may be less than 75% or greater than 125% the thickness of the inner wall 194.

The lower portion 192 of the inner surface 162 may be characterized as the portion of the inner surface below the lower circumferential edge 196 of the inner wall 194. The lower portion 192 may include one or more retaining elements 200 configured to resist removal of the collar 112 from the body 104, i.e., resist axial separation of the collar 112 from the body 104. The one or more retaining elements 200 may be configured in a variety of ways. For example, the size, the shape, the location, the orientation, and the number of retaining elements 200 may vary in different configurations of the container. Any configuration capable of resisting axial separation of the collar 112 from the body 104 may be used.

In the illustrated container, each of the one or more retaining elements 200 is configured as a ridge extending radially inward from the lower portion 192. Each ridge-shaped retaining element 200 has a convex inner edge 202 that extends radially inward a maximum distance X2 (FIG. 2) from the inner surface 162. The centerline of the convex inner edge 202 is positioned a distance X3 (FIG. 5) from the lower circumferential edge 196 of the inner wall 194. In other configurations of the container, however, the inner edge 202 of each of the retaining elements 200 may not be convex. Each of the ridge-shaped retaining elements 200 extends circumferentially along the inner surface 162 a distance X4 in degrees with the inner edge 202 parallel to the lower circumferential edge 196 of the inner wall 194. In the illustrated container, each of the ridge-shaped retaining elements 200 circumferentially extends in the range of 5 degrees to 15 degrees, or 10 degrees. In other configurations of the container, however, each of the ridge-shaped retaining elements 200 may circumferentially extend less than 5 degrees or greater than 15 degrees around the inner surface 162.

In the illustrated container, the collar 112 includes six pairs of retaining elements 200 for a total of twelve retaining elements 200 on the inner surface 162. Each pair of retaining elements 200 includes two retaining elements circumferentially side-by-side. Each pair of retaining elements 200 is circumferentially spaced apart from the next pair. For example, one pair of retaining elements 200 may circumferentially extend about 20 degrees along the inner surface 162 followed by about 10 degrees of inner surface 162 with no retaining element, with the pattern repeating around the entire circumference of the inner surface 162.

The lower portion 192 may include one or more anti-rotation elements 210 configured to resist rotation of the collar 112 relative to the body 104, i.e., resist rotation about longitudinal axis A. The one or more anti-rotation elements 210 may be configured in a variety of ways. For example, the size, the shape, the location, the orientation, and the number of anti-rotation elements 210 may be vary in different configurations of the container. Any configuration capable of resisting rotation about longitudinal axis A of the collar 112 relative to the body 104 may be used.

In the illustrated container, each of the anti-rotation elements 210 is formed as an elongated rib extending longitudinally along the inner surface 162 of the lower portion 192. In the illustrated container, each of the rib-shaped anti-rotation elements 210 is axially aligned with and coextensive with a bridge 198. In other configurations of the container, however, one or more of the rib-shaped anti-rotation elements 210 may not be axially aligned and coextensive with a bridge 198.

Each anti-rotation element 210 has a distal end 212 connected to a proximal end 214 opposite the distal end 212 by an inner face 216 and a pair of opposite lateral faces 217, such that the anti-rotation element 210 is generally rectangular in cross-section. In other configurations of the container, however, the anti-rotation element 210 have other than rectangular in cross-section, such as for example, semicircular.

In the illustrated container, the distal end 212 has a convex curved surface and the inner face 216 is planar. In other configurations of the container, however, the inner face 216 may be other than planar, such as curved for example and the distal end 212 may be configure other than convex, such as planar for example. Further, in the illustrated container, the proximal end 214 is connected to a bridge 198. In other configurations of the container, however, the proximal end 214 may be spaced apart from a bridge 198.

Figure 4:
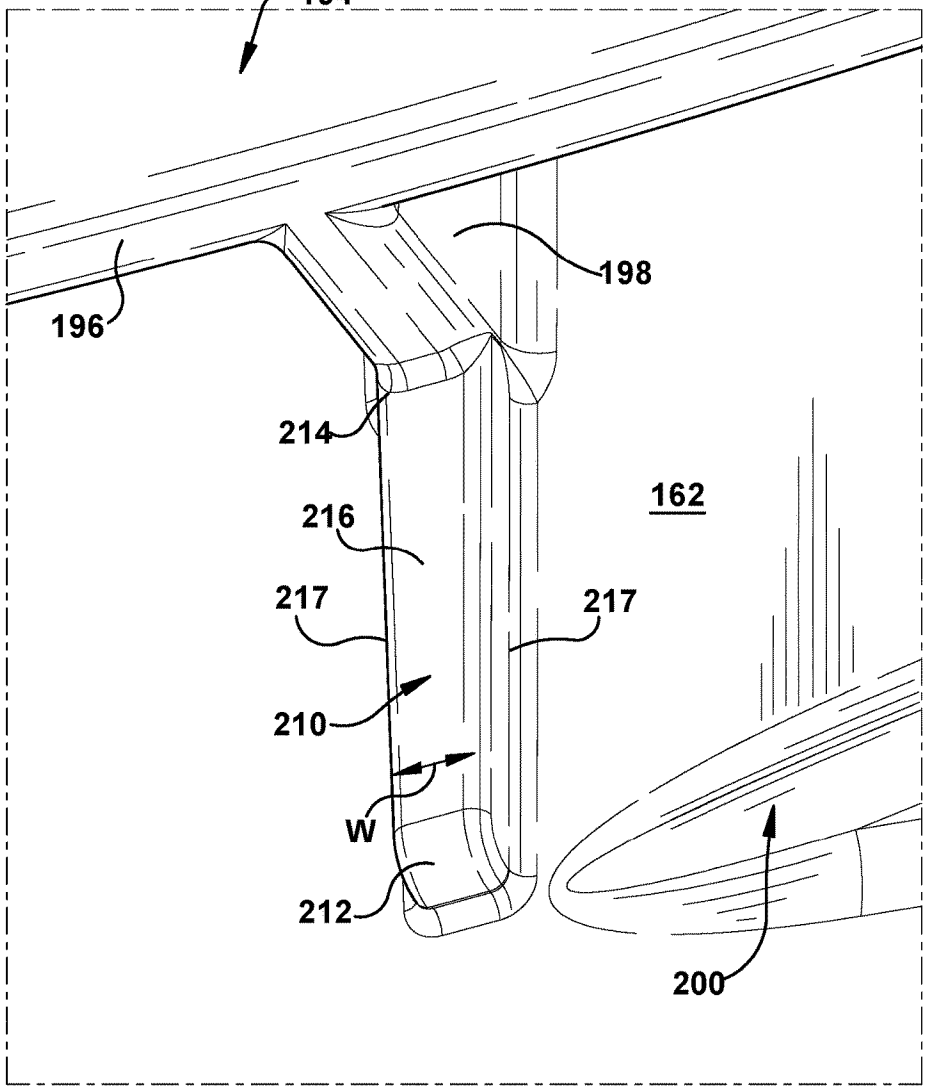
FIG. 4 is a perspective view of an anti-rotation rib of the collar.

Each anti-rotation element 210 has a length L, a thickness T, and a width W (FIGS. 4-5). The width W and the thickness T may be constant, or generally constant, along the length L of each anti-rotation element 210. In other configurations of the container, however, the width W and/or the thickness T may vary along the length of each anti-rotation element 210. For example, each anti-rotation element 210 may taper toward the distal end 212 such that the thickness T deceases from the proximal end 214 to the distal end 212.

In one exemplary configuration of the container 100, the length L is in the range of 3.302 inches (0.130 inches) to 4.318 mm (0.170 inches), or 3.81 mm (0.150 inches). In other configurations, however, the length L may be grater than 4.318 mm or less than 3.302 mm. In one exemplary configuration of the container 100, the thickness T is in the range of 0.435 mm (0.017 inches) to 0.835 mm (0.033 inches), or 0.535 mm (0.021 inches) to 0.735 mm (0.029 inches), or 0.635 mm (0.025 inches). In other embodiments, however, the thickness T may be greater than 0.835 mm or less than 0.435 mm. In one exemplary configuration of the container 100, width W is in the range of 0.435 mm (0.017 inches) to 0.835 mm (0.033 inches), or 0.535 mm (0.021 inches) to 0.735 mm (0.029 inches), or 0.635 mm (0.025 inches). In other embodiments, however, the width W may be greater than 0.835 mm or less than 0.435 mm. In one exemplary configuration of the container 100, the width W is equal to the thickness T. In other configurations, however, the width W is not equal to the thickness T. In one exemplary configuration of the container 100, one or more anti-rotation elements have a length L such that the distal end 212 terminates at the centerline of the convex inner edge 202 of the retaining elements 200. Thus, in one exemplary configuration of the container 100, the length L is equal to the distance X3. In other embodiments, however, the length L may be greater or less than the distance X3.

In the illustrated container, each of the anti-rotation elements 210 is circumferentially offset from each of the retaining elements 200. The arrangement of anti-rotation elements 210 relative to retaining elements 200 may vary in different configurations of the container. Any suitable arrangement may be used. For example, the illustrated container includes eight (8) anti-rotation elements 210 spaced circumferentially around of the inner surface 162 and six pairs of retaining elements 200. Referring to FIG. 2, the collar 112 includes at least one arrangement (labeled as arrangement B in FIG. 2) that includes an anti-rotation element 210 positioned circumferentially between two retaining elements 200 of one of the pairs of retaining elements 200 with sections of the inner surface 162 with no retaining elements 200 or anti-rotation elements 210 on either side of the pair of retaining elements 200. The collar 112 also includes at least one arrangement (labeled as arrangement C in FIG. 2) that includes no anti-rotation element 210 positioned circumferentially between two retaining elements 200 of one of the pairs of retaining elements 200 with two anti-rotation elements 210 on either side of the pair of retaining elements 200 and sections of the inner surface 162 with no retaining elements 200 on either side of the anti-rotation elements 210. Any suitable arrangement of anti-rotation elements 210 and retaining elements 200 may be used.

The collar 112 and the lid 116 may be constructed from any suitable material. In one configuration of the container, the collar 112 and the lid 116 are constructed from a polymeric material, such as, for example, polypropylene, high-density polyethylene (HDPE), low-density polyethylene (LDPE), polyethylene terephthalate (PET), and/or polycarbonate. In an exemplary configuration of the container, the collar 112 and the lid 116 are constructed from the same material as the body 104. In other configurations of the container, however, the collar 112 and the lid 116 are constructed from one or more different materials than the body 104. In addition, the anti-rotation elements 210 may be configured from any suitable material, including a polymeric material, such as, for example, polypropylene, high-density polyethylene (HDPE), low-density polyethylene (LDPE), polyethylene terephthalate (PET), and/or polycarbonate that is the same as the collar 112 or different than the collar 112.

The collar 112 may attach to the container body 104 in a variety of ways including clips, friction-fit configurations, snap-on arrangements and other equally desirable and optional components and methods. In the illustrated container, the collar 112 is configured to be attached and assembled to the container 100 by pressing the collar 112 axially downward onto the upper portion 114 of the body 104. When the collar 112 is pressed downward onto the upper portion 114, the retaining elements 200 engage the annular flange 128 resulting in the sidewall 106 of the body 104 deflecting radially inward and/or the cylindrical side wall 160 of the collar 112 deflecting radially outward to allow the retaining elements 200 to move past the annular flange 128. Alternatively, or in conjunction with one or both of the side walls 106, 160 deflecting, one or both of the retaining elements 200 and annular flange 128 may elastically deform to allow the retaining elements 200 to pass the annular flange 128.

Once the retaining elements 200 are moved downward past the annular flange 128, the sidewall 106 of the body 104 and/or side wall 160 of the collar 112 return to their pre-deflected position, or toward their pre-deflected position, such that each of the retaining elements 200 snap under the annular flange 128 and are positioned below the annular flange 128. Alternatively, or in conjunction with one or both of the side walls 106, 160 returning to, or toward, their pre-deflected position, one or both of the retaining elements 200 and annular flange 128 may return to their pre-deformed configuration, or toward their pre-deformed configuration. When the retaining elements 200 are positioned below the annular flange 128, axial separation of the collar 112 from the body 104 is resisted because the annular flange 128 interferes with the retaining elements 200 moving in an axially upward direction. In this way, the annular flange 128 and the retaining elements 200 act as a detent mechanism that keeps the collar 112 in position relative to the body 104.

As the collar 112 is pressed axially downward onto the upper portion 114 of the body 104, the lower circumferential edge 196 of the inner wall 194 and/or the bridges 198 may act as a stop to prevent further axially movement downward of the collar 112 relative to the body 104. In particular, the lower circumferential edge 196 and/or the bridges 198 may engage the upper circumferential edge 126 of the upper portion 114 of the body 104 preventing further downward axially movement of the collar 112 relative to the body 104.

Further, as shown in FIG. 5, while the collar 112 is pressed axially downward onto the upper portion 114 of the body 104, and/or once the retaining elements 200 have been moved past the annular flange 128, one or more of the anti-rotation elements 210 will engage the annular flange 128. In particular, the inner face 216 of one or more of the anti-rotation elements 210 engages the exterior surface 130 of the annular flange 128. As a result, the anti-rotation elements 210 form a friction fit against the exterior surface 130 of the annular flange 128 that resists, or prevents, rotational movement about the axis A of the collar 112 relative to the body 104. For example, one or more anti-rotation elements 210 may interfere with the exterior surface 130 of the annular flange 128 to resist rotation of the collar 112. The amount of interference between the one or more anti-rotation elements 210 and the annular flange 128 may vary in different applications. In some configurations, the interference between the one or more anti-rotation elements 210 and the annular flange 128 is in the range of 0.0254 mm (0.001 inches) to 3.175 mm (0.125 inches). In other configurations, however, the interferences can be greater than 3.175 mm (0.125 inches).

In one exemplary configuration of the container, one or more of the anti-rotation elements 210 will plastically deform against the annular flange 128. For example, as the collar 112 is pressed axially downward onto the upper portion 114 of the body 104, one or more of the anti-rotation elements 210 may plastically deform 220 (e.g., smear) as the anti-rotation elements 210 engage the annular flange 128. Any number of the one or more anti-rotation elements 210 may plastically deform when the engaging the annular flange 128, including all of the anti-rotation elements 210 or less than all of the anti-rotation elements. In other configurations of the container, however, the anti-rotation elements 210 may not plastically deform against the annular flange 128. For example, the sidewall 106 of the body 104 may deflect inward and/or the cylindrical side wall 160 of the collar 112 may deflect outward such that a friction fit is still formed between the anti-rotation elements 210 and the annual flange 128 to resist rotation of the collar 112 relative to the body 104, but the fit does not result in the anti-rotation elements 210 plastically deforming.

As shown in FIG. 5, the collar 112 is configured such that the anti-rotation elements 210 do not engage the body 104 along the inner surface 120 or on the upper circumferential edge 126. In the illustrated container, for example, the anti-rotation elements 210 only engage the body 104 at the exterior surface 130 of the annular flange 128. Further, in some configurations of the container, the collar 112 does not engage the body 104 at all along the inner surface 120.

Due to the configuration of the collar-body interface and the configuration and orientation of the anti-rotation elements 210, the anti-rotation elements 210 are self-adjusting. For example, tolerance variation in the diameter D1 of the outer surface 122 of the upper portion 114 of the body 104, the maximum distance X1 the annular flange 128 extends from the outer surface 122, the diameter D2 of the inner surface 162 of the collar 112, and the thickness T of the anti-rotation elements 210 can impact the fit of the collar 112 onto the upper portion 114 of the body 104. The anti-rotation elements 210 can compensate for some tolerance variation due to the degree in which anti-rotation elements 210 plastically deform and the orientation of the anti-rotation elements around the circumference of the inner surface 162 of the collar 112, which provides a centering function. Thus, the amount of deformation of the anti-rotation elements 210 allows the collar 112 to fit cans with varying annular flange diameters (i.e., manufacturing tolerance).

While various inventive aspects, concepts, and features of the general inventive concepts are described and illustrated herein in the context of various exemplary configurations of a container, these various aspects, concepts, and features may be used in many alternative configurations, either individually or in various combinations thereof. Unless expressly excluded herein all such combinations are intended to be within the scope of the general inventive concepts. Still further, while various alternative configurations as to the various aspects, concepts, and features of the inventions (such as alternative materials, structures, configurations, methods, devices and components, alternatives as to form, fit and function, and so on) may be described herein, such descriptions are not intended to be a complete or exhaustive list of available alternative configurations, whether presently known or later developed. Those skilled in the art may readily adopt one or more of the inventive aspects, concepts, or features into additional configurations of a container and uses within the scope of the general inventive concepts even if such configurations are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features, and concepts may be expressly identified herein as being inventive or forming part of an invention, such identification is not intended to be exclusive, but rather there may be inventive aspects, concepts, and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A container, comprising:

a main body including one or more sidewalls having an interior surface and an exterior surface and defining an interior compartment, the one or more sidewalls having an upper portion defining a circular opening to the interior compartment and an annular flange extending from the exterior surface; and a lid-collar assembly comprising a lid attached to a collar affixed to the main body, the collar having an inner side surface positioned radially outward of the annular flange and a plurality of longitudinally extending ribs spaced apart on the inner side surface;

wherein the plurality of longitudinally extending ribs engage the annular flange to resist rotation of the lid-collar assembly relative to the main body; and wherein the inner side surface of the collar further includes a plurality of retaining elements that interact with the annular flange to resist axial separation of the lid-collar assembly from the main body; and wherein each of the plurality of retaining elements is circumferentially offset from each of the plurality of longitudinally extending ribs.

2. The container of claim 1, wherein the annular flange extends radially outward from the upper portion.

3. The container of claim 1, wherein the lid-collar assembly does not engage the interior surface of the one or more sidewalls.

4. The container of claim 1, wherein the plurality of longitudinally extending ribs create a friction fit with the annular flange.

5. The container of claim 1, wherein one or more of the plurality of longitudinally extending ribs plastically deforms against the annular flange.

6. The container of claim 1, wherein each of the plurality of retaining elements is disposed below the annular flange.

7. The container of claim 1, wherein the main body is cylindrical.

8. The container of claim 1, wherein the collar includes one or more radially extending bridges that engage an uppermost edge of the main body to act as stop surfaces, and wherein each of the longitudinally extending ribs is circumferentially aligned with a corresponding radially extending bridge.

9. The container of claim 1, wherein the plurality of longitudinally extending ribs comprise four to ten longitudinally extending ribs.

10. A method of securing the lid-collar assembly onto the main body to form the container of claim 1, comprising:

pressing the lid-collar assembly onto the container body such that the inner side surface of the collar is radially outward of the exterior surface of the one or more sidewalls of the main body;

positioning the one or more retaining elements located on the inner side surface beneath the annular flange to resist axial separation of the lid-collar assembly from the main body; and creating a friction fit between the plurality of ribs and the annular flange to resist rotation of the lid-collar assembly relative to the main body;

wherein creating the friction fit comprises plastically deforming one or more of the plurality of ribs.

11. The method of claim 10, further comprising abutting one or more stop surfaces against an uppermost edge of the main body to limit how far the lid-collar assembly can be pressed onto the main body.

12. The container of claim 1, wherein each of the plurality of longitudinally extending ribs tapers toward a distal end, such that the thickness decreases from a proximal end to the distal end.

13. The container of claim 1, wherein each of the plurality of retaining elements has a convex inner edge that extends radially inward from the inner surface.

14. The container of claim 13, wherein each of the plurality of longitudinally extending ribs has a distal end that terminates at a centerline of the convex inner edge of the plurality of retaining elements.

15. The container of claim 1, further comprising a container-locking feature that includes a latch on the collar and a keeper on the lid.

16. The container of claim 15, wherein the latch extends from the outer surface of the collar via a hinge that allows the latch to pivot relative to the collar between a latched position and an unlatched position.

17. The container of claim 1, further comprising a removable, substantially moisture-impervious, oxygen-impervious seal between the lid and the interior compartment.

18. The container of claim 1, wherein an underside of the lid contains a scoop retention feature.

19. The container of claim 1, wherein each of the plurality of retaining elements is separate from each of the plurality of longitudinally extending ribs.

* * * * *